US007096854B2

(12) United States Patent
Boecking

(10) Patent No.: US 7,096,854 B2
(45) Date of Patent: Aug. 29, 2006

(54) FUEL INJECTION DEVICE FOR INTERNAL COMBUSTION ENGINES

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 384 days.

(21) Appl. No.: 10/399,660

(22) PCT Filed: Jul. 5, 2002

(86) PCT No.: PCT/DE02/02462

§ 371 (c)(1),
(2), (4) Date: Sep. 26, 2003

(87) PCT Pub. No.: WO03/019000

PCT Pub. Date: Mar. 6, 2003

(65) Prior Publication Data

US 2006/0042596 A1 Mar. 2, 2006

(30) Foreign Application Priority Data

Aug. 22, 2001 (DE) ..... 101 41 111

(51) Int. Cl.
*F02M 37/04* (2006.01)

(52) U.S. Cl. ..... 123/446; 123/467

(58) Field of Classification Search ..... 123/446, 123/458, 514, 467, 500, 501
See application file for complete search history.

(56) References Cited

U.S. PATENT DOCUMENTS

| | | | | | |
|---|---|---|---|---|---|
| 4,060,347 | A | * | 11/1977 | Jarret | 417/392 |
| 5,732,679 | A | * | 3/1998 | Takahasi et al. | 123/467 |
| 5,893,350 | A | * | 4/1999 | Timms | 123/467 |
| 5,979,410 | A | * | 11/1999 | Grieshaber | 123/467 |
| 6,910,463 | B1 | * | 6/2005 | Oshizawa et al. | 123/446 |

FOREIGN PATENT DOCUMENTS

| | | | |
|---|---|---|---|
| DE | 19956598 | * | 6/2001 |
| DE | 10008268 | * | 8/2001 |
| EP | 0691471 | * | 1/1996 |

* cited by examiner

*Primary Examiner*—Carl S. Miller
(74) *Attorney, Agent, or Firm*—Ronald E. Greigg

(57) ABSTRACT

A fuel injection device includes an injection valve connected in an injection line for the fuel and having a nozzle chamber and a control chamber that are both connected to the injection line, an on-off valve for switching back and forth between a lower injection pressure and a higher injection pressure, and a valve device for controlling the pressure prevailing in the control chamber. A shared actuator is provided for the valve device and the on-off valve, wherein the actuation distance of the shared actuator required to open the on-off valve is greater than the actuation distance required to open the valve device.

15 Claims, 2 Drawing Sheets

FUEL INJECTION DEVICE FOR INTERNAL COMBUSTION ENGINES

CROSS-REFERENCE TO RELATED APPLICATIONS

This application is a 35 USC 371 application of PCT/DE 02/02462 filed on Jul. 5, 2002.

BACKGROUND OF THE INVENTION

1. Field of the Invention

The invention is directed to an improved fuel injection device for internal combustion engines.

2. Description of the Prior Art

In a known fuel injection device of the type with which this invention is concerned, disclosed in DE 199 10 970 A1, the control chamber can be connected to a relief line by means of a 2/2-way valve. Another 2/2-way valve serves to activate a pressure booster that is used to generate a second, higher injection pressure.

SUMMARY OF THE INVENTION

The fuel injection device according to the invention has the advantage over the prior art that the on-off valve and the valve device are actuated by means of a single actuator, thus making it possible to eliminate one actuator.

In a preferred embodiment of the invention, the first relief valve can execute the main injection and the second relief valve can execute a secondary injection. The two relief valves series connected to each other can be advantageously integrated into a ball valve with a double seat.

BRIEF DESCRIPTION OF THE DRAWINGS

The fuel injection device according to the invention will be more fully described herein below, with reference to the drawings, in which.

DESCRIPTION OF THE PREFERRED EMBODIMENTS

Figure 1:
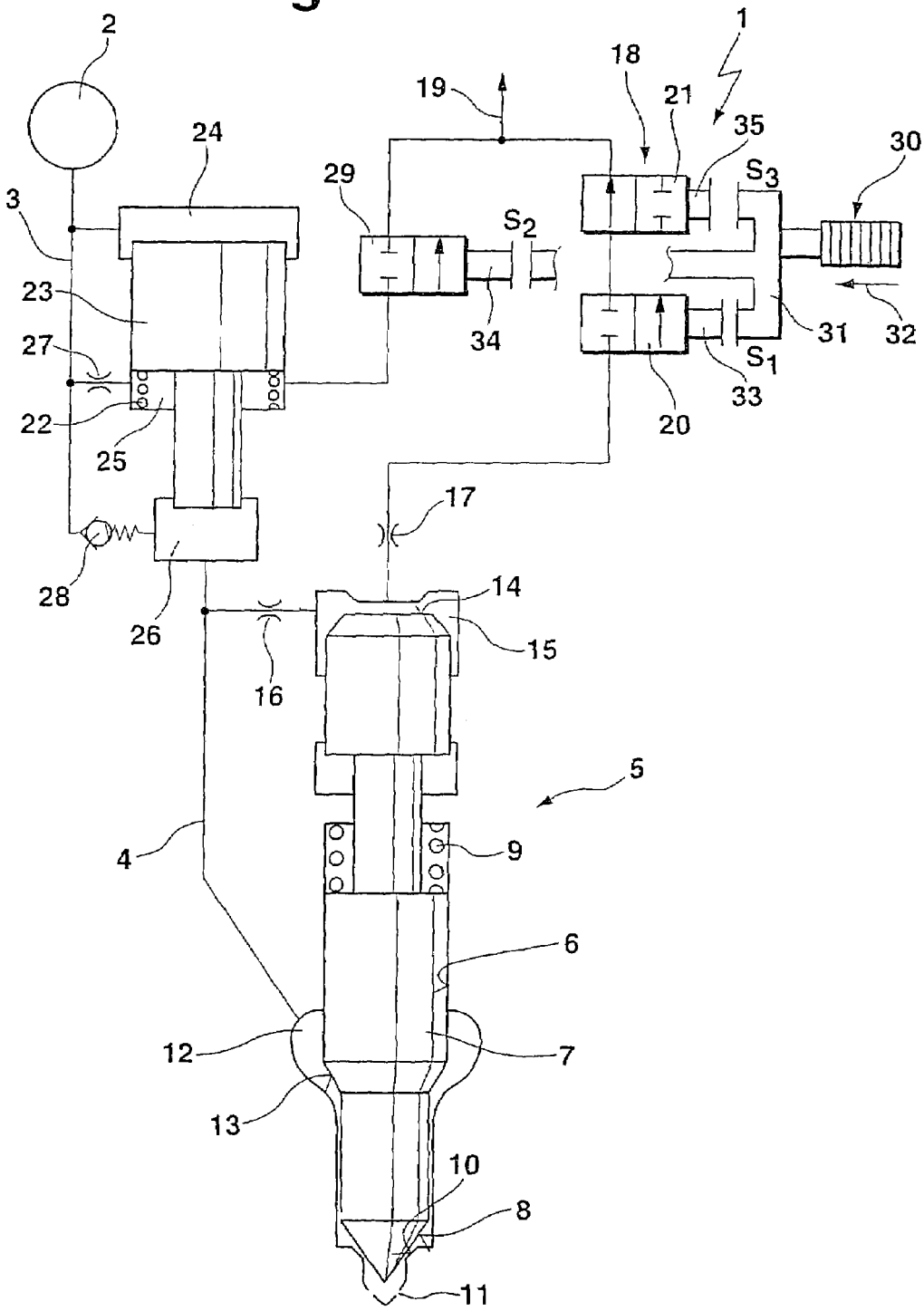
FIG. 1 shows the essential components of a fuel injection device according to the invention, with a shared actuator for the valves provided to control the injection process.

The fuel injection device 1 for internal combustion engines shown in FIG. 1 includes a high-pressure reservoir 2 (common rail), in which fuel is stored at a first injection pressure P1. The fuel travels from the high-pressure reservoir 2 via respective pressure lines 3 and injection lines 4 to the individual injection valves (injectors) 5—only one of which is shown in FIG. 1—that protrude into the combustion chamber of the internal combustion engine to be supplied.

A piston-shaped valve element (nozzle needle) 7 with a conical valve sealing surface 8 is guided in a sliding fashion in an axial guide bore 6 of the injection valve 5; a closing spring 9 pushes this valve element against a conical valve seat surface 10 of the valve housing, thus closing the injection openings 11 provided there. In the injection valve 5, the injection line 4 feeds into an annular nozzle chamber 12, from which an annular gap between the guide bore 6 and the valve element 7 leads to the valve seat surface 10. In the vicinity of the nozzle chamber 12, the valve element 7 has a first control surface 13 embodied as a pressure shoulder against which the fuel supplied via the injection line 4 acts on the valve member 7 in the opening direction (i.e. inward). The end of the valve element 7 oriented away from the valve sealing surface 8 constitutes a second control surface 14, which defines a control chamber 15 and acts in the valve closing direction. The control chamber 15 can be connected to the injection line 4 by means of an inlet throttle 16 and can be connected to a relief line (overflow fuel) 19 via an outlet throttle 17 and a valve device 18. The valve device 18 includes two relief valves 20, 21 connected in series, which are each embodied as a 2/2-way valve. The second control surface 14 is larger than the first control surface 13 so that when the valve device 18 is closed, i.e. when the pressure in the nozzle chamber 12 and the control chamber 15 is the same, the valve element 7 closes the injection openings 11. The inlet throttle 16 is smaller than the outlet throttle 17 so that when the valve device 18 is open, the pressure prevailing in the control chamber 15 is reduced by means of the relief line 19 and the pressure prevailing in the nozzle chamber 12 is then sufficient to open the valve element 7 counter to the action of the closing spring 9.

For each injection valve 5, a local pressure booster is provided, with a booster piston 23 that can be slid axially counter to the action of a return spring 22 and has a primary chamber 24 on the primary end, a secondary chamber 25 on the secondary end, and defines a pressure chamber 26 on the pressure side. The primary chamber 24 is directly connected to the pressure line 3, the secondary chamber 25 is connected to the pressure line 3 via a throttle 27, the pressure chamber 26 is connected to the pressure line 3 via a check valve 28, and the injection line 4 leads away from the pressure chamber 26. An on-off valve 29 embodied as a 2/2-way valve can connect the secondary chamber 25 to the relief line 19. When the on-off valve 29 is closed, the fuel pressure P1 of the pressure reservoir 2 prevails in all three chambers 24, 25, 26 so that the return spring 22 pushes the booster piston 23 into its initial position. If an opening of the on-off valve 29 relieves the pressure in the secondary chamber 25, then the booster piston 23 is slid in the compression direction and thus compresses the fuel in the pressure chamber 26 to a higher injection pressure P2 in accordance with the piston cross sectional ratio in the primary chamber 24 and the pressure chamber 26. The check valve 28 here prevents compressed fuel from flowing back into the pressure line 3.

The two relief valves 20, 21 and the on-off valve 29 are provided with a shared piezoelectric actuator 30, which actuates the valves 20, 21, 29 starting at different respective actuation distances. The actuation distance S2 required to open the on-off valve 29 is greater than the actuation distance S1 required to open the first relief valve 20 and smaller than the actuation distance S3 required to open the second relief valve 21, i.e. S1<S2<S3. The actuator 3 includes an actuating element 31, which in the starting position of the actuator 30 shown in FIG. 1, is spaced apart in the actuating direction 32 from the actuating element 33 of the first relief valve 20 by the actuation distance S1, is spaced apart from the actuating element 34 of the on-off valve 29 by the actuation distance S2, and is spaced apart from the actuating element 35 of the second relief valve 21 by the actuation distance S3. As a result, the actuating element 31 drives and thus actuates the actuating elements 33, 34, 35 of the individual valves starting at different respective actuation distances.

Figure 2:
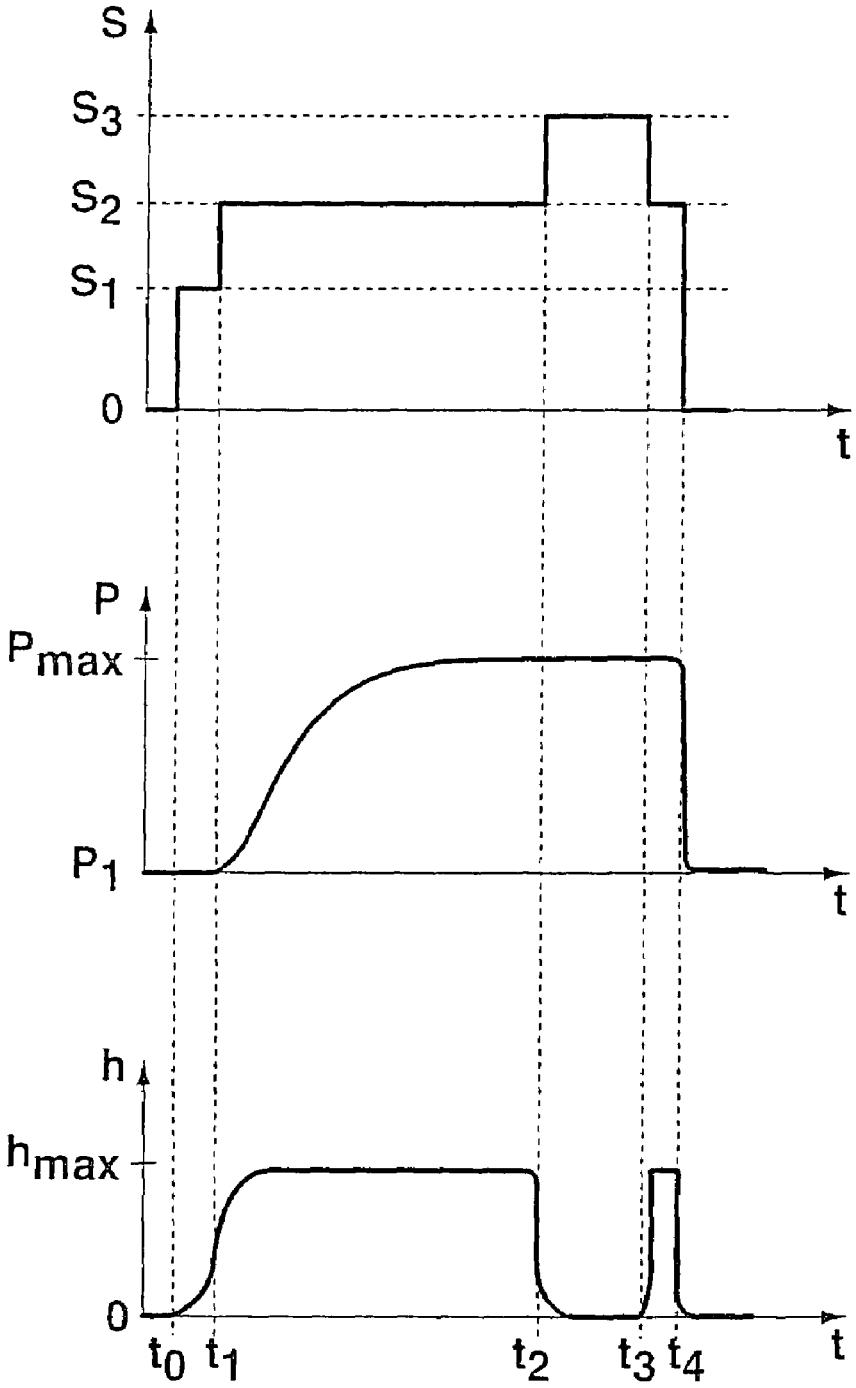
FIG. 2 shows a diagram that indicates the actuation distance (S) of the shared actuator, the injection pressure (P), and the stroke (h) of the valve element over the time axis for the fuel injection device shown in FIG. 1.

In FIG. 2, the chronological course of the injection process is plotted in a diagram.

The sliding of the actuating element 31 by the actuation distance S1 at time t0 initiates the beginning of the injection process. This opens the first relief valve 20 and relieves the pressure in the control chamber 15. The fuel pressure P1 of the pressure reservoir 2 prevailing in the nozzle chamber 12 is then sufficient to open the valve element 7 counter to the action of the closing spring 9 so that fuel emerges from the injection openings 11 at the fuel pressure P1.

The sliding of the actuating element 31 by the actuation distance S2 at time t1 opens the on-off valve 29 and thus relieves the pressure in the secondary chamber 25. A higher injection pressure builds up in the pressure chamber 26 and therefore also in the nozzle chamber 12, which therefore causes the valve element 7 to open to a maximal stroke $h_{max}$ and the injection to be continued at the higher injection pressure. The maximal injection pressure $P_{max}$ is generated as a function of the piston cross sectional ratio in the primary chamber 24 and the pressure chamber 26.

At a time t2 at which the pressure prevailing in the nozzle chamber 12 is still higher than the fuel pressure P1 of the pressure reservoir 2, the sliding of the actuating element 31 by the actuation distance S3 closes the second relief valve 21. The control chamber 15 is no longer pressure-relieved so that the valve element 7 closes the injection openings 11.

At time t3, the returning of the actuating element 31 to the actuation distance S2 causes the second relief valve 21 to open again. The control chamber 15 is once again pressure-relieved and the valve element 7 opens so that the fuel is injected at the fuel pressure prevailing the injection chamber 12, i.e. the pressure P2.

The returning of the actuating element 31 to its starting position at time t4 terminates the injection. This causes the on-off valve 29 to close—as a result of which the secondary chamber 25 is no longer pressure-relieved and therefore the return spring 22 pushes the booster piston 23 back into its starting position—and also causes the first relief valve 20 to close—as a result of which the control chamber 15 that is now no longer pressure-relieved fills with fuel from the pressure reservoir 2 by means of the pressure chamber 26, and the valve element 7 closes.

The foregoing relates to preferred exemplary embodiments of the invention, it being understood that other variants and embodiments thereof are possible within the spirit and scope of the invention, the latter being defined by the appended claims.

I claim:

1. A fuel injection device (1) for internal combustion engines, comprising a plurality of injection valves (5) each provided in an injection line (4) for the fuel, each injection valve (5) having a nozzle chamber (12) and a control chamber (15) that are each connected to the injection line (4), a valve element (7) that controls the injection openings (11) of the nozzle chamber (12) and that can be actuated by means of a first control surface (13) disposed in the nozzle chamber (12) and acting in the valve opening direction, and by means of a second control surface (14) disposed in the control chamber (15) and acting in the valve closing direction, an on-off valve (29) for switching back and forth between a lower injection pressure and a higher injection pressure, a valve device (18) for controlling the pressure prevailing in the control chamber (15), and a shared actuator (30) for the valve device (18) and the on-off valve (29), the valve device (18) including means such that upon travel of shared actuator (30) by a chosen distance (Si) the valve device (18) opens, and upon travel of a second, greater distance (S3), the valve device (18) closes, the actuation distance (S2) of the shared actuator (30) required to open the on-off valve (29) being greater than the actuation distance (S1) required to open the valve device (18) and less than the actuation distance (S3) required to close the valve device (18).

2. The fuel injection device according to claim 1, wherein the valve device (18) comprises a first relief valve (20) that can be actuated by the shared actuator (30), and wherein the actuation distance (S2) required to open the on-off valve (29) is greater than the actuation distance (S1) required to open the first relief valve (20).

3. The fuel injection device according to claim 1, wherein the valve device (18) comprises a first relief valve (20) that can be actuated by the shared actuator (30), and wherein the actuation distance (S2) required to open the on-off valve (29) is greater than the actuation distance (S 1) required to open the first relief valve (20).

4. A fuel injection device (1) for internal combustion engines, comprising a plurality of injection valves (5) each provided in an injection line (4) for the fuel, each injection valve (5) having a nozzle chamber (12) and a control chamber (15) that are each connected to the injection line (4), a valve element (7) that controls the injection openings (11) of the nozzle chamber (12) and that can be actuated by means of a first control surface (13) disposed in the nozzle chamber (12) and acting in the valve opening direction, and by means of a second control surface (14) disposed in the control chamber (15) and acting in the valve closing direction, an on-off valve (29) for switching back and forth between a lower injection pressure and a higher injection pressure, a valve device (18) for controlling the pressure prevailing in the control chamber (15), and a shared actuator (30) for the valve device (18) and the on-off valve (29), the actuation distance (S2) of the shared actuator (30) required to open the on-off valve (29) being treater than the actuation distance (Si) required to open the valve device (18), wherein the valve device (18) comprises a first relief valve (20) that can be actuated by the shared actuator (30), and wherein the actuation distance (S2) required to open the on-off valve (29) is greater than the actuation distance (S1) required to open the first relief valve (20), and wherein the valve device (18) comprises a second relief valve (21) that can be actuated by the shared actuator (30) and is connected in series with the first relief valve (20), and wherein the actuation distance (S3) of the shared actuator (30) required to close the second relief valve (21) is greater than the actuation distance (S2) required to open the on-off valve (29).

5. The fuel injection device according to claim 1, wherein the valve body or bodies of the valve device (18) and the on-off valve (29) are motion-coupled to the shared actuator (30), each starting at different actuation distances.

6. The fuel injection device according to claim 2, wherein the valve body or bodies of the valve device (18) and the on-off valve (29) are motion-coupled to the shared actuator (30), each starting at different actuation distances.

7. The fuel injection device according to claim 4, wherein the valve body or bodies of the valve device (18) and the on-off valve (29) are motion-coupled to the shared actuator (30), each starting at different actuation distances.

8. The fuel injection device according to claim 1, wherein the on-off valve (29) and/or the first relief valve (20) and/or the second relief valve (21) are each embodied as a 2/2-way valve.

9. The fuel injection device according to claim 2, wherein the on-off valve (29) and/or the first relief valve (20) and/or the second relief valve (21) are each embodied as a 2/2-way valve.

10. The fuel injection device according to claim 4, wherein the on-off valve (29) and/or the first relief valve (20) and/or the second relief valve (21) are each embodied as a 2/2-way valve.

11. The fuel injection device according to claim 1, wherein the shared actuator (30) is embodied as a piezo-electric actuator.

12. The fuel injection device according to claim 1, wherein at least the lower injection pressure (P1) is stored in a central pressure reservoir (20).

13. The fuel injection device according to claim 1, wherein the injection line (4) is connected to the lower injection pressure (P1) via a check valve (28) and is also connected to the pressure chamber (26) of a pressure booster piston (23) that can be activated by means of the on-off valve (29).

14. The fuel injection device according to claim 2, wherein the injection line (4) is connected to the lower injection pressure (P1) via a check valve (28) and is also connected to the pressure chamber (26) of a pressure booster piston (23) that can be activated by means of the on-off valve (29).

15. The fuel injection device according to claim 4, wherein the injection line (4) is connected to the lower injection pressure (P1) via a check valve (28) and is also connected to the pressure chamber (26) of a pressure booster piston (23) that can be activated by means of the on-off valve (29).

* * * * *